US006902464B1

(12) United States Patent
Lee

(10) Patent No.: US 6,902,464 B1
(45) Date of Patent: Jun. 7, 2005

(54) ROLLING TOY

(75) Inventor: Michael Pui Kuen Lee, Hong Kong (CN)

(73) Assignee: Silver Manufactory Holdings Company Limited, Kowloon (HK)

( * ) Notice: Subject to any disclaimer, the term of this patent is extended or adjusted under 35 U.S.C. 154(b) by 0 days.

(21) Appl. No.: 10/849,313

(22) Filed: May 19, 2004

(51) Int. Cl.[7] ..... A63H 30/04

(52) U.S. Cl. ..... 446/456; 446/409; 446/438; 473/570; 473/594

(58) Field of Search ..... 446/438, 413, 446/236, 484, 457, 458, 409, 396, 431, 454, 456; 473/570, 594, 571; 180/6.2, 6.48

(56) References Cited

U.S. PATENT DOCUMENTS 2,104,636 A * 1/1938 Burcham ..... 40/411
4,726,800 A * 2/1988 Kobayashi ..... 446/458
4,897,070 A * 1/1990 Wagstaff ..... 446/273
5,045,014 A * 9/1991 Harkins ..... 446/236
5,439,408 A * 8/1995 Wilkinson ..... 446/409
5,533,920 A * 7/1996 Arad et al. ..... 446/409
5,676,582 A * 10/1997 Lin ..... 446/130
5,692,946 A * 12/1997 Ku ..... 446/456
5,720,644 A * 2/1998 Ku ..... 446/175
5,871,386 A * 2/1999 Bart et al. ..... 446/460
6,227,933 B1 * 5/2001 Michaud et al. ..... 446/462

* cited by examiner

*Primary Examiner*—Bena B. Miller
(74) *Attorney, Agent, or Firm*—Alix, Yale & Ristas, LLP

(57) ABSTRACT

A rolling toy includes a chassis, an electric power source attached to the chassis, a remote signal receiver, an electric motor attached to the chassis and receiving power from the power source in response to a signal received by the remote signal receiver, a pair of riding surface-engaging wheels mounted co-axially to the chassis and capable of rotating independently of one another, and wherein at least one of the wheels is driven to rotate by the electric motor, and a dome-shaped profile formed on each wheel and adapted to bear upon the riding surface to assist in righting the toy, should it topple in use.

9 Claims, 6 Drawing Sheets

ROLLING TOY

BACKGROUND OF THE INVENTION

The present invention relates to a rolling toy. More particularly, although not exclusively, the invention relates to a battery-powered, remote-controlled toy dominated by a pair of coaxial drive wheels that can be driven in the same or opposite directions so that the toy can perform a variety of dynamic movements.

Remotely controlled toy cars and other toy vehicles are known. These comprise a motor—usually powered by a rechargeable battery, and driving a pair of road wheels via a mechanical transmission. Control signals from a remote location are received by an onboard receiver that controls the motor. Steering control is accomplished by a separate servo unit that receives signals via the onboard receiver.

OBJECT OF THE INVENTION

It is an object of the present invention to provide a remotely controlled rolling toy of alternative design and construction providing interesting dynamic movements.

DISCLOSURE OF THE INVENTION

There is disclosed herein a rolling toy comprising:

a chassis, an electric power source attached to the chassis, a remote signal receiver, an electric motor attached to the chassis and receiving power from the power source in response to a signal received by the remote signal receiver, a pair of riding surface-engaging wheels mounted co-axially to the chassis and capable of rotating independently of one another, and wherein at least one of the wheels is driven to rotate by the electric motor, and a dome-shaped profile formed on each wheel and adapted to bear upon the riding surface to assist in righting the toy, should it topple in use.

Preferably the chassis forms a hub flanked at opposed sides by the riding service-engaging wheels.

Preferably one of the wheels has connected with it an input gear, and the electric motor drives the input gear.

Preferably both of the wheels are driven to rotate by the electric motor.

Preferably the rolling toy further comprises a further electric motor and wherein the other wheel is driven to rotate by the further electric motor.

Preferably the other wheel has an input gear, and the further electric motor has an output sprocket that drivers this input gear.

Preferably the rolling toy further comprises an arm extending radially from the chassis and having an end that can engage with a riding surface to restrict counter-rotation of the hub.

Preferably the arm is light-transmissive, and the toy further comprises a light source at the chassis directing light into the arm.

Preferably the light source produces intermittent light, or light of differing colour.

Preferably the toy further comprises a speaker mounted to the chassis and a sound generator from which the speaker receives an electrical signal.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
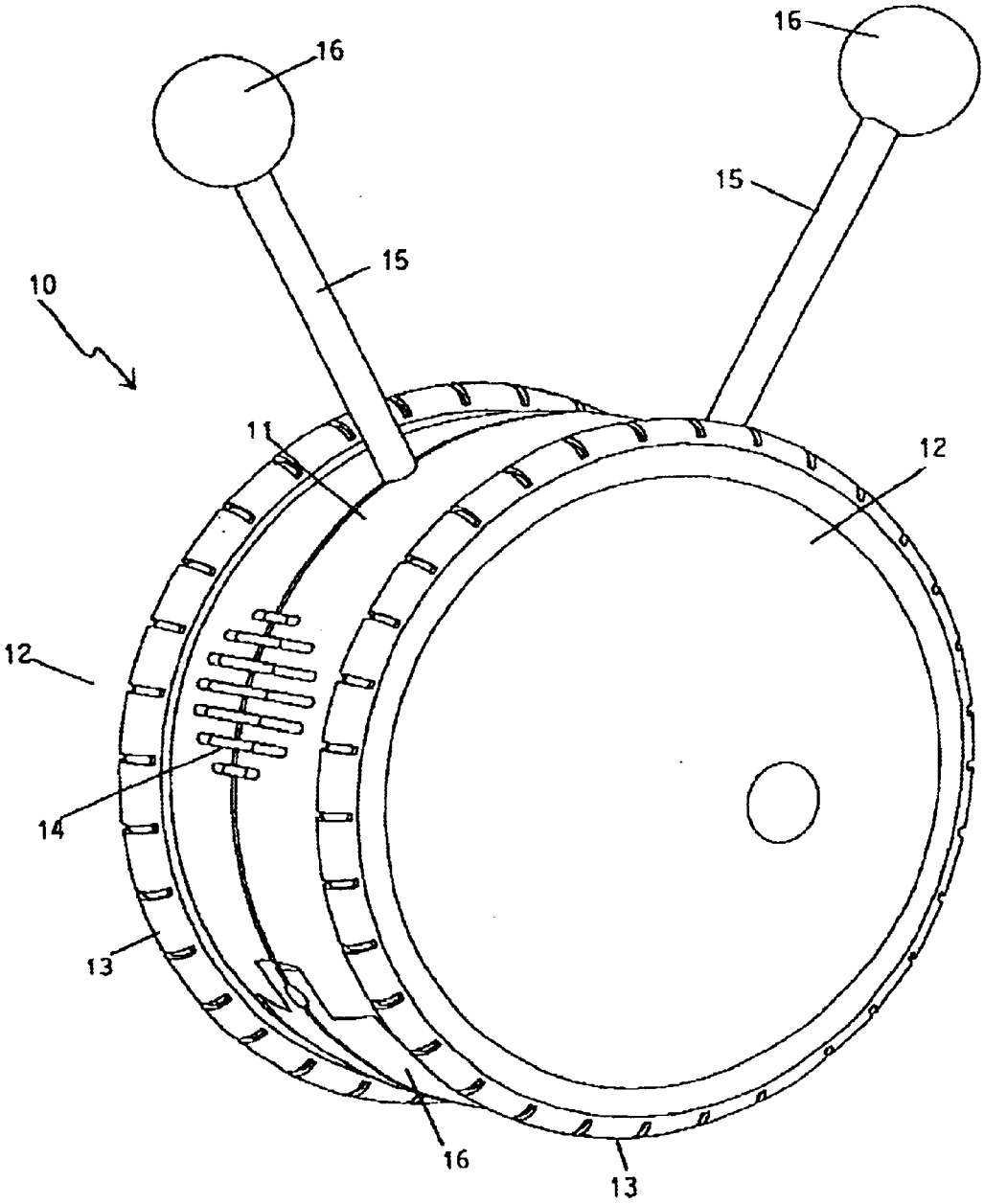
FIG. 1 is a schematic perspective illustration of a rolling toy.
Figure 2:
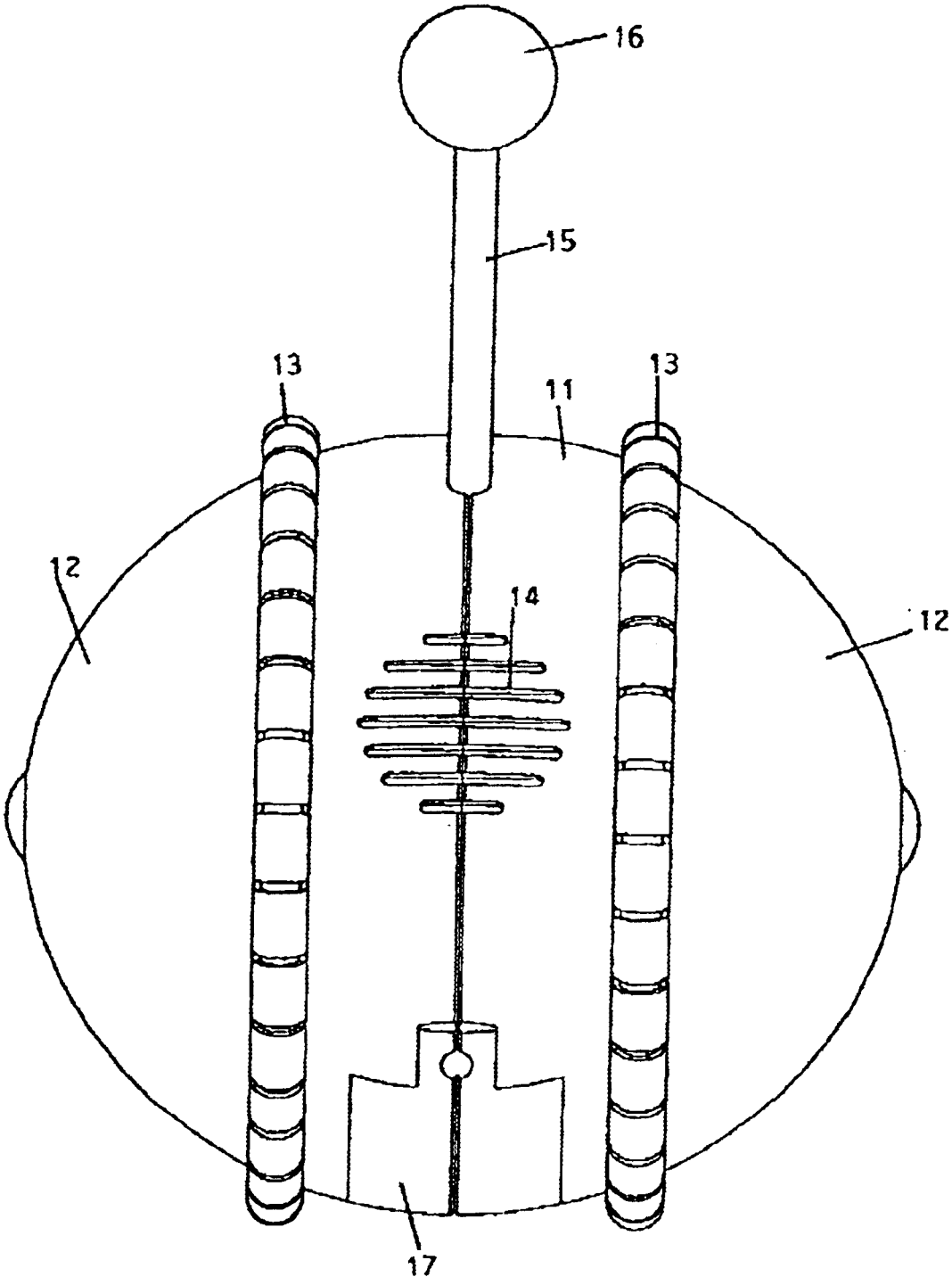
FIG. 2 is a schematic front elevation of the rolling toy of FIG. 1.
Figure 3:
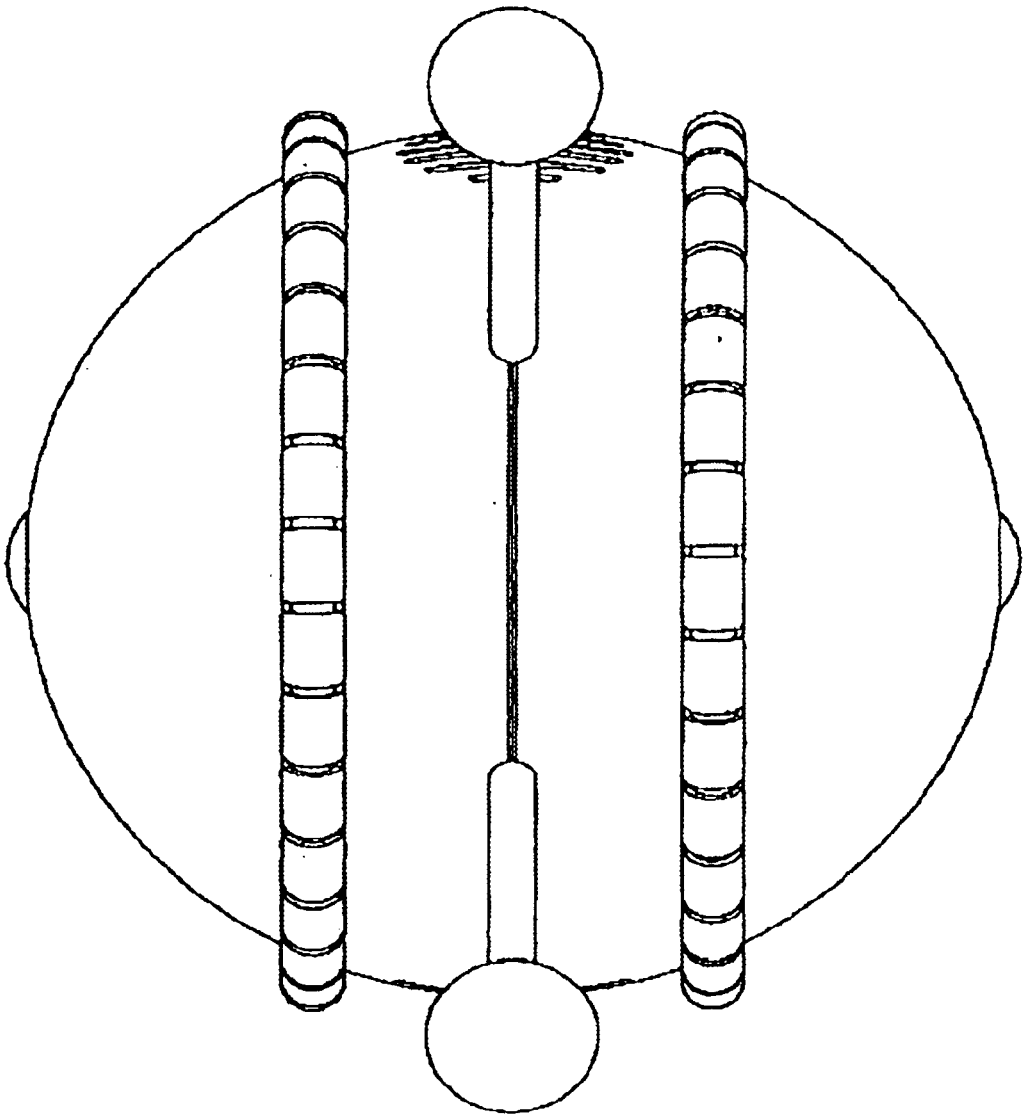
FIG. 3 is a schematic plan view of the rolling toy of FIGS. 1 and 2.
Figure 4:
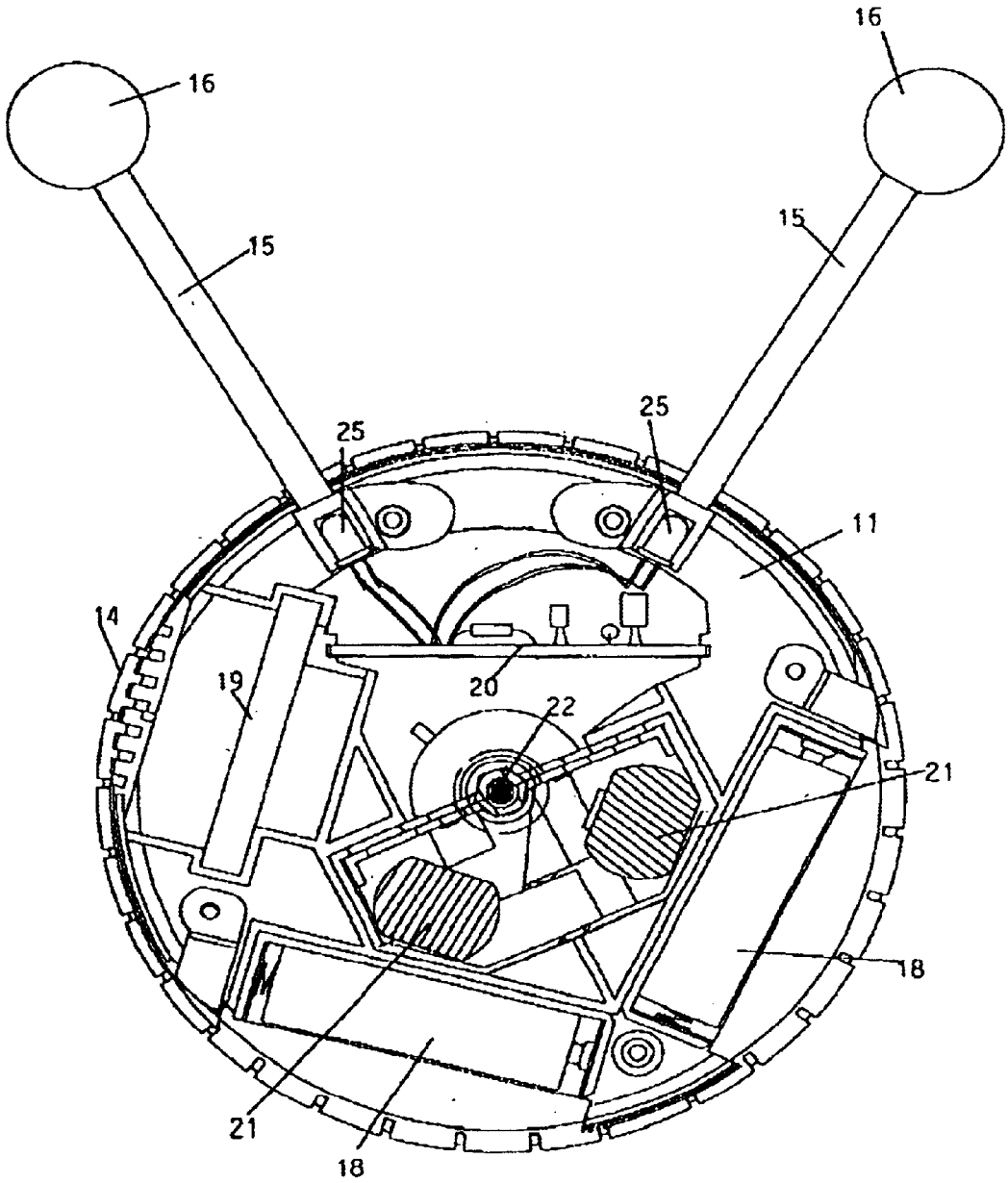
FIG. 4 is a schematic side elevation of the interior of the rolling toy of FIGS. 1 to 3.
Figure 5:
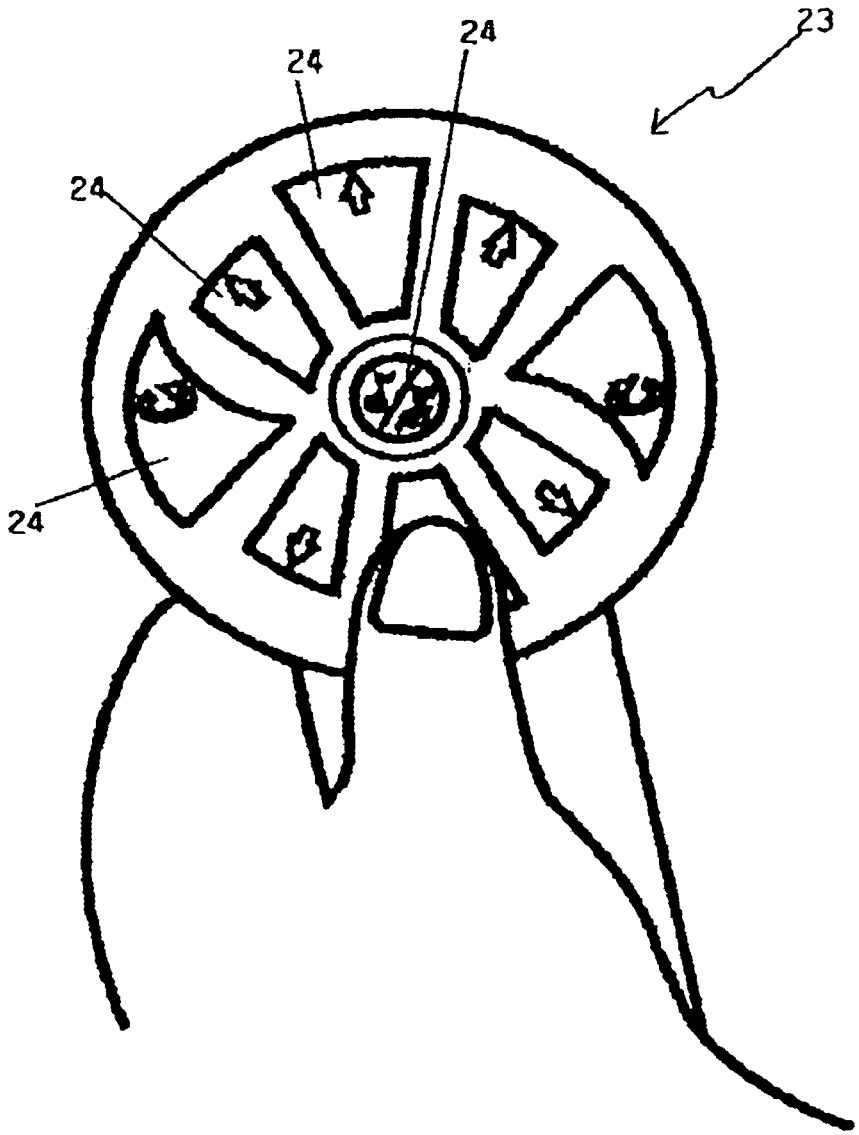
FIG. 5 is a schematic illustration of a remote control unit for use with the toy of FIG. 1 to 4.

In the accompanying drawings there is depicted schematically a rolling toy 10. The toy 10 includes a chassis 11 flanked at either side by a pair of dome-shaped wheels 12. Each wheel has a tyre 13 attached at its periphery. There is a speaker grille 14 upon the periphery of the chassis 11 and a pair of arms 15 extending radially from the chassis—each arm having a ball-shaped end 16. There is a battery compartment door 17 concealing a number of batteries 18 within the chassis 11. Apart from powering the toy, the batteries provide "ballast" to by the toy into its upright configuration as depicted in FIG. 1 and have a significant role in defining the centre of gravity of the toy.

There is a speaker 19 mounted internally to the chassis and this receives sound signals from a sound processor located upon a printed circuit board 20.

Also mounted internally of the chassis is a pair of electric motors 21.

Each motor 21 receives power from the batteries 18 upon receipt of control signals from the printed circuit board 20. The printed circuit board also serves as a remote signal receiver and processor for independently controlling operation of each motor 21. There is also an LED 25 at the base of each arm 15 directing light through each arm. In this regard, it should be noted that each arm is light-transmissive and preferably transparent, so that the light emitted by each LED 25 reaches the ball-shaped end 16 of each arm.

The chassis comprises a pair of coaxial axles 22 upon which the wheels 12 are mounted.

A remote control unit 23 comprising a number of keys 24 is provided with the toy. Depression of one of the keys 24 or a combination of keys will result in different actions. One of keys might turn the LEDs on and off, or activate or deactivate a signal generator on the PCB 20 that sends illumination sequences to the LEDs. One key might activate one of the electric motors only and another key might activate the other electric motor only. One button might activate one motor in a reverse direction and another key might activate the other motor in a reverse direction. One key might activate both electric motors in the same direction or opposite directions etc. One key might turn the sound generator on and off.

Figure 6:
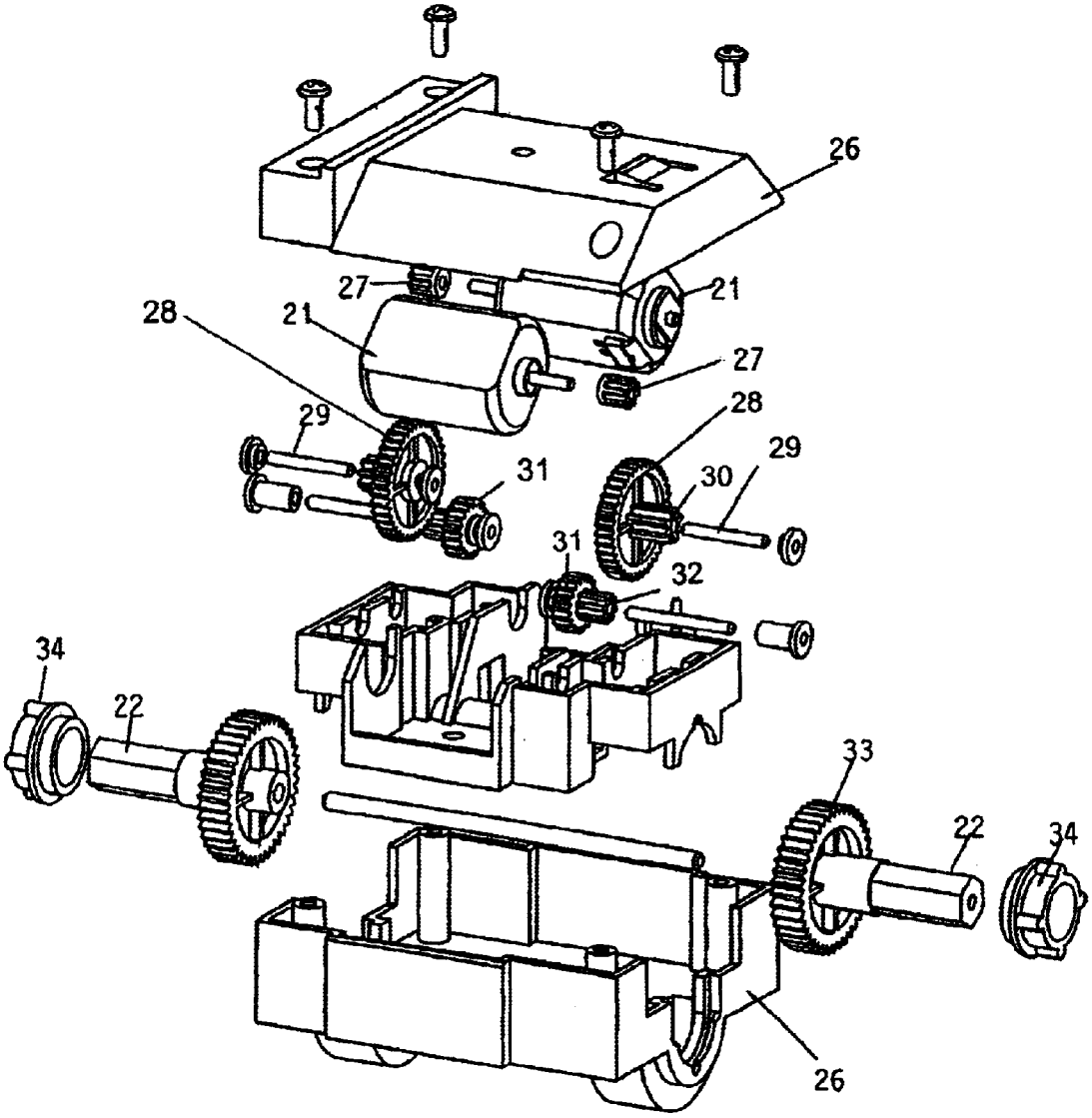
FIG. 6 is a schematic parts-exploded perspective illustration of the internal driving mechanism of the rolling toys of FIGS. 1 to 5.

As shown in FIG. 6, the internal drive mechanism includes a housing 26 within which the electric motors 21 are supported. Each motor comprises an output pinion 27 that drives a gear wheel 28 upon a shaft 29. There is an intermediate pinion 30 formed integrally with the gear wheel 28 upon the shaft 29. The intermediate pinion 30 drives a further gear wheel 31 with which there is formed integrally a further pinion 32. This pinion 32 drives an output gear 33 upon each of shafts 22. A sprocket 34 is fixed to each shaft 22 for attachment to a respective one of the domed wheels 12.

In use, and upon carefully timed depression of selected keys, the toy can be made to roll in a straight line, turned a corner, spin on the spot, play music and flash its lights. During motion of the toy upon a floor surface, the ends 16 of the arms 15 engaged with the floor surface to limit the angular range through which the chassis can counter-rotate as a reaction to rotation of the wheels. Should the toy topple in use, the dome-shaped profile of each wheel bears against the riding surface so as to "roll" the toying to its upright position. The centre of gravity of the toying as influenced strongly by the position of the batteries assists in this return-to-use action.

Due to the substantially spherical construction of the toy body, the user can—with the remote control—create interesting dynamic movements by manipulating the position of the centre of gravity of the toy with respect to the position at which it contacts the riding surface.

The dynamic motion of the toy is affected by the position of the centre of gravity of the toy, the speed of rotation of the wheels. Due to the ballast provided by the batteries and the action of the arm, the toy will always return to the upright position when it returns to rest.

It should be appreciated that modifications and alterations obvious to those skilled in the art are not to be considered as beyond the scope of the present invention. For example, instead of having two separate motors, a single motor might suffice, and a simple output-selection gearbox might be associated with the single motor to enable unitary, reverse, or synchronised rotation of the wheels 12.

What is claimed is:

1. A rolling toy comprising:

a chassis, an electrical power source attached to the chassis, a remote signal receiver, an electric motor attached to the chassis and receiving power from the power source in response to a signal received by the remote signal receiver, a pair of riding surface-engaging wheels mounted co-axially to the chassis and capable of rotating independently of one another, and wherein at least one of the wheels is driven to rotate by the electric motor, wherein one of the wheels is connected to an input gear, and the electric motor drives the input gear, and a dome-shaped profile formed on each wheel and adapted to bear upon the riding surface to assist in righting the toy, should it topple in use.

2. The rolling toy of claim 1, wherein the chassis forms a hub flanked at opposed sides by the riding service-engaging wheels.

3. The rolling toy of claim 2, further comprising an arm extending radially from the chassis and having an end that can engage with a riding surface to restrict counter-rotation of the hub.

4. The rolling toy of claim 3 wherein the arm is light-transmissive, and further comprising a light source at the chassis for directing light into the arm.

5. The rolling toy of claim 4 wherein the light source produces intermittent light, or light of differing colour.

6. The rolling toy of claim 1, wherein both of the wheels are driven to rotate by the electric motor.

7. The rolling toy of claim 1, comprising a further electric motor and wherein the other wheel is driven to rotate by the further electric motor.

8. The rolling toy of claim 7, wherein the other wheel has an input gear, and the further electric motor has an output sprocket that drives the input gear.

9. The rolling toy of claim 1 further comprising a speaker mounted to the chassis and a sound generator from which the speaker receives an electrical signal.

* * * * *